US005497891A

United States Patent [19]

Hannon

[11] Patent Number: 5,497,891

[45] Date of Patent: Mar. 12, 1996

[54] SUPPORT FOR GOLF BAG

[76] Inventor: J. R. Hannon, 1105 Hwy. 8 East, Pelzer, S.C. 29669

[21] Appl. No.: 314,636

[22] Filed: Sep. 29, 1994

[51] Int. Cl.[6] ..... A47G 29/00; B65D 85/20; A63B 55/00

[52] U.S. Cl. ..... 211/71; 211/13; 211/175; 206/315.1; D3/255; 248/96; 248/145.6; 248/152

[58] Field of Search ..... 211/71, 70.2, 13, 211/175, 62; 248/96, 152, 145.6; 206/45.14, 44 R, 315.1; D3/255, 259, 315, 316; D34/15

[56] References Cited

U.S. PATENT DOCUMENTS 2,520,226 8/1950 Smith ..... 211/70.2

5,087,003 2/1992 Montgomery ..... 248/96

FOREIGN PATENT DOCUMENTS 4660 of 1907 United Kingdom ..... 248/96

2180200 3/1987 United Kingdom ..... 248/96

*Primary Examiner*—Leslie A. Braun

*Assistant Examiner*—Willie Berry, Jr.

*Attorney, Agent, or Firm*—Henry S. Jaudon; Cort Flint

[57] ABSTRACT

A portable rack for supporting and displaying golf bags comprising a housing having a bottom and a top which are vertically spaced by an outer shell. A golf bag supporting cradle is formed within a portion of the outer shell. The cradle is C-shaped and includes upstanding body portion connected with a base. It is slanted inward so that gravity will maintain a golf bag in an upstanding position within the cradle.

20 Claims, 2 Drawing Sheets

SUPPORT FOR GOLF BAG

BACKGROUND OF THE INVENTION

The present invention is directed to a rack constructed to support golf bags for storage or display.

There have been a plurality of devices constructed to support golf bags for temporary or long term storage. The long term devices generally include racks having horizontally arranged slots in which the bags are maintained while not in use. Normally the devices devised for temporary storage comprise horizontal rails arranged at about two and one half feet (2½') above ground level and provided with transverse extensions which individually locate the bags along the rail. These devices are normally used just before or after play.

The most common storage arrangement for golf bags in the home is the corner of a closet or basement. This arrangement is not particularly satisfactory as the bags tend to slip or fall and the walls are defaced.

More decorative golf bag storage racks are known such as the one disclosed in U.S. Pat. No. 5,087,003. Here a furniture type stand is constructed to include shelves and bag compartments. This structure will adequately support golf bags, however, it is relatively expensive, space consuming, and not constructed for outside use.

The instant invention has as its object a golf bag support rack which may be used in the home, in display rooms, in storage rooms, or out of doors.

Another object is to provide a low cost golf bag support rack.

Another object is to provide a unitary compact golf bag support rack.

Another object of the invention is to provide a molded light weight golf bag rack.

Another object of the invention is to provide a golf bag rack which is adjustable to accommodate one or more golf bags.

Another object of the invention is to provide a golf bag support rack comprised of a plurality of individual housings which are united to form a unitary support structure.

SUMMARY OF THE INVENTION

The present invention is directed to a portable rack for supporting and displaying golf bags. The rack includes a housing having a base, an outer shell and a top, the top being vertically spaced from the base by the outer shell. A bag supporting cradle is formed within a portion of the outer shell. The cradle is constructed to include a U-shaped upstanding body portion and a bottom. The body portion is slanted inward of the outer shell.

The housing is formed with an enclosed hollow interior. An opening which is provided with a closure, is formed in the outer shell and affords access to the hollow interior. The rack is made stable by at least partially filling its interior with a heavy material such as sand or water.

A pair of opposed handles are formed in an upper area of the outer shell of the housing. Each handle is shaped as an internally directed cavity substantially in the shape of an upwardly directed half C.

The rack may include a plurality of housings which are secured together. A locking member is provided which secures with the handles of adjacent housings and releasably secures them together. The locking piece is also C shaped so that it mates with the interior area of each of the handles.

A drain is arranged in the bottom of the cradle at its lowest point. The drain comprises a tube formed integral with the bottom of the cradle and the base of the housing.

The dimensions of the rack include a top of approximately 16" in length, a bottom of approximately 24" in length. The top and bottom are separated by an outer shell which is approximately 30" high.

A rack for supporting and displaying golf bags comprising a housing molded from one of plastic, rubber or fiberglass. The housing includes a top, a base, opposed sides, a back, a front, and a hollow water tight interior. The front is formed to include a golf bag supporting cradle. The back is formed to include an opening which provides access to the hollow interior of the housing. A removable closure is provided to close the opening. The rack may be made stable by partially filling or emptying the interior with heavy matter.

The golf bag supporting cradle is C-shaped with an open top and a closed bottom. It extends substantially the entire length of the housing front. The cradle is tilted so that when a golf bag is placed therein gravity maintains it securely seated.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
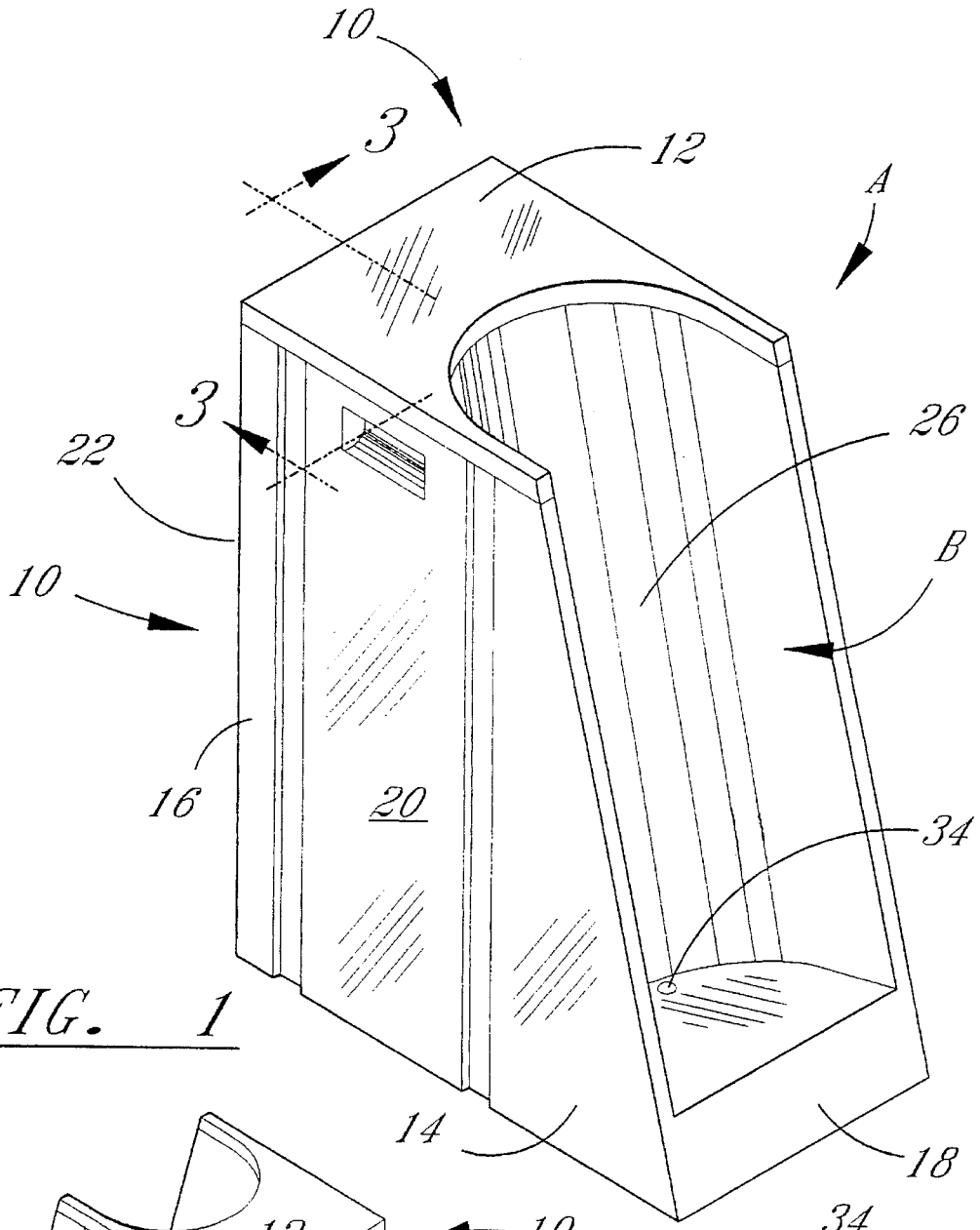
FIG. 1 is a perspective view of the golf bag rack of the invention.

Referring now to FIG. 1, the golf bag supporting rack A of the invention is shown. Rack A which is molded into shape includes a housing 10 formed with a top 12, a base 14 and an outer shell 16. Shell 16 comprises a front 18, a back 22 and a pair of sides 20.

Rack A is generally trapezoidally shaped with top 10 and base 14 being generally parallel and vertically spaced by shell 16. Front 18 is disposed at about 20° from vertical while back 22 is generally vertically disposed. It is preferred that housing 10 be formed at a height of approximately 30", that it be approximately 24" along base 14 and 16" along top 12. Also, housing 10 is preferably formed to be 13.5" wide. These dimensions are optional and variations are possible. The only requirement is that the housing be wide enough to carry a cradle sufficiently large enough to accommodate substantially all golf bags and that the height is such as to allow the upper portion of the golf bag to extend above top 12 of rack A.

A cradle B is provided in front 18. The cradle is formed as a C-shaped cavity 26 which extends from top 12 to just above base 14, leaving the lower portion of front 18 only about 3" in height. Cradle B and front 18 are arranged along substantially parallel axes which means that it is also slightly tilted. Cradle A includes a bottom 24 which is formed integral with front 18 and with the walls of cavity 26. The bottom is arranged at a slight angle to be substantially perpendicular of the longitudinal extension of cavity 26.

Cradle B includes a drain 34 formed in bottom 24 at its lowest point. Drain 34 comprises of a tube 36 molded at one end with bottom 24 and at its opposite end with base 14.

Figure 4:
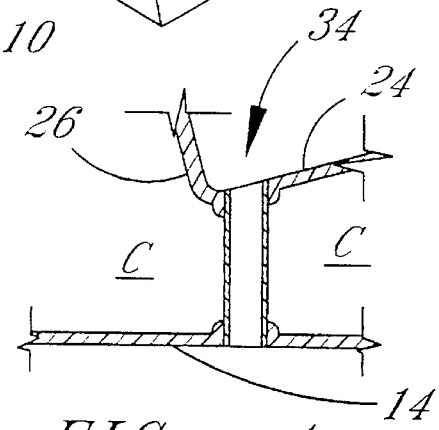
FIG. 4 is a sectional view showing the drainage tube connected with the base of the golf bag cradle and the housing base.
Figure 5:
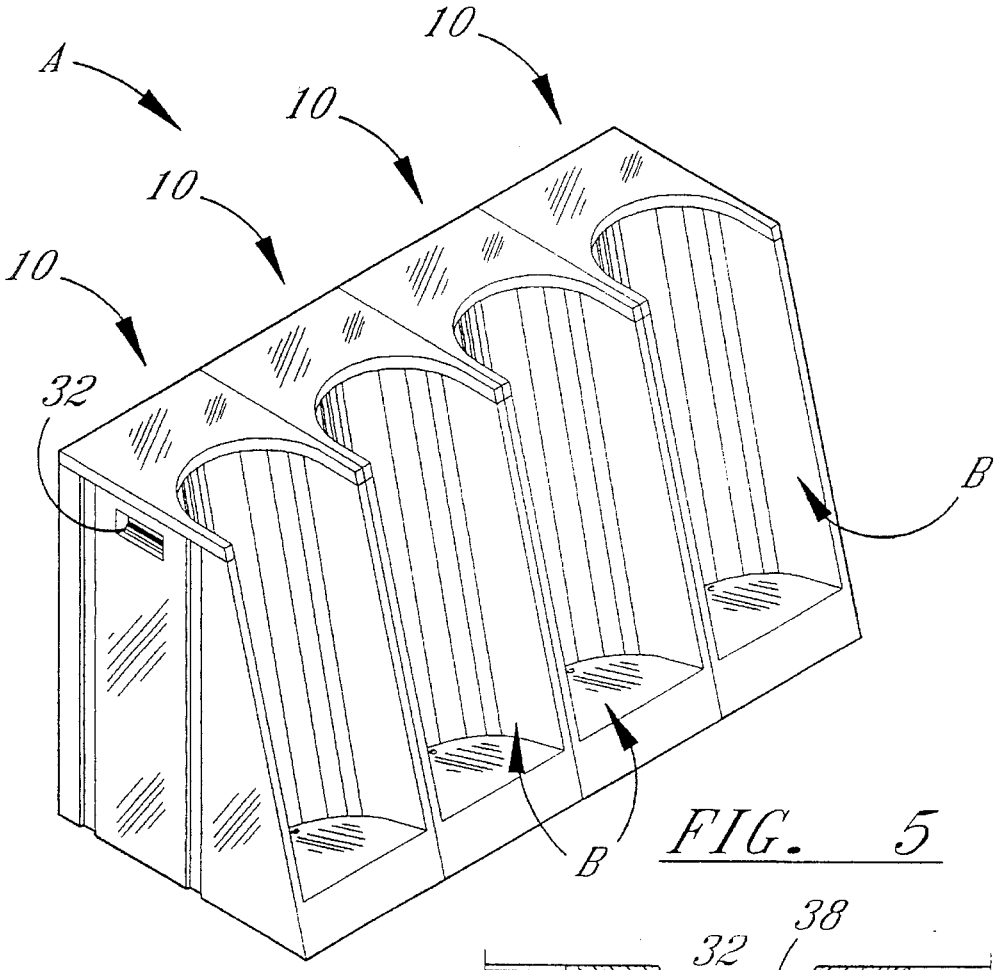
FIG. 5 is a perspective view showing a plurality of golf bag racks secured together.
Figure 3:
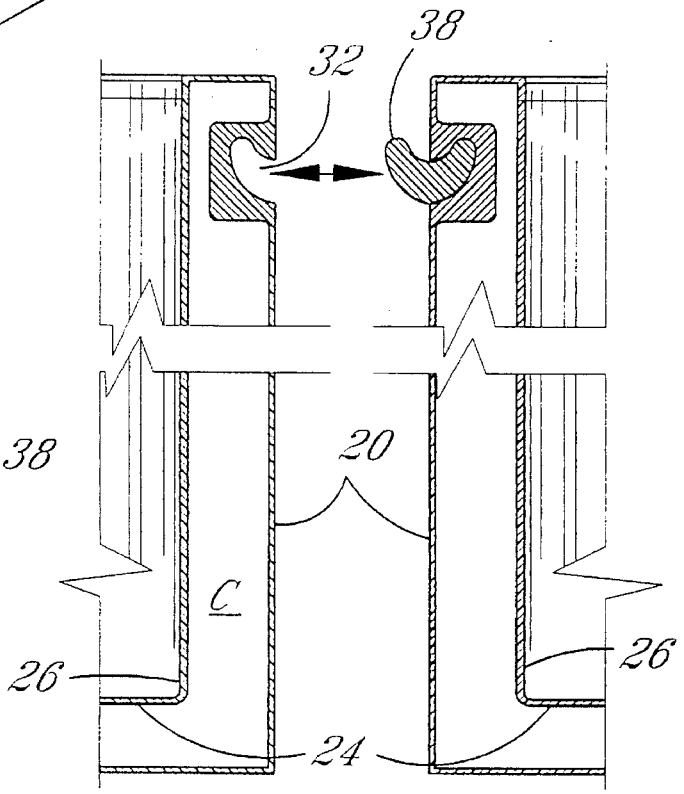
FIG. 3 is a sectional frontal view showing a pair of adjacent golf bag racks in position to be secured together.

Housing 10 is formed with a hollow water tight interior C as best seen in FIG. 3. Drain 34 does not connect with interior C as best shown in FIG. 4. An opening 28 is formed generally in the vicinity of the midpoint of back 22 and provides access to cavity C. A closure 30 is provided to seal opening 28 and cavity C.

Figure 6:
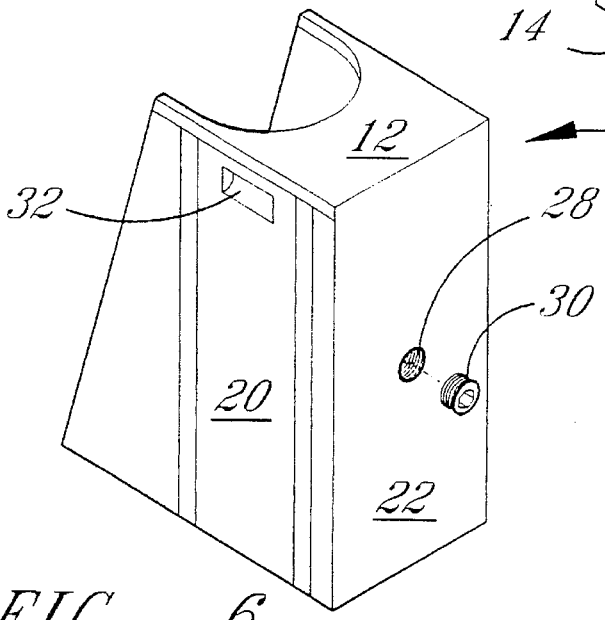
FIG. 6 is a perspective view taken from the back side of the golf bag rack.

As best seen in FIGS. 1, 3, and 6, sides 20 are formed with handles 32. The handles are shaped in the general configuration of the upper half of a C and are formed inwardly of sides 20 in the vicinity of top 12.

Figure 2:
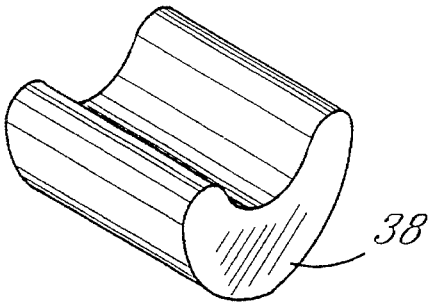
FIG. 2 is a perspective view of the locking piece.

A locking piece 38, as shown in FIGS. 2 and 3, is provided. The locking piece is generally C-shaped and sized so that approximately half its structure matingly fits within a handle 32. A pair of housing 10 may be secured together when locking piece 32 is engaged a pair of adjacent handles 32.

Golf bag support rack A may be formed of a plurality of housings 10, as shown in FIG. 4, made integral by locking the housings 10 together with securing member 36 as described above.

Support and display rack A is preferably formed of plastic and shaped by the process of roto-molding. While the preferred plastic is normally selected between polyethylenes, polyamides, and polystyrenes, other plastics may be used. Other suitable materials include rubber and fiberglass.

In use, rack A may constitute only a single housing 10 as shown in FIG. 1 or it may comprise a plurality of housings 10 secured together as shown in FIG. 6. In either case, it is usually desirable that rack A be weighted to make it more stable so that it will generally remain in place during use. This is accomplished by removing closure 30 and filling interior C with a heavy material through opening 28. Generally, somewhere in the vicinity of one third full is sufficient to adequately increase the weight of the lower area of housings 10 and to firmly locate rack A. The most accessible weighting materials are sand or water, although other substances may be used.

Due to the tilted configuration of cradle B, gravity causes the golf bags placed therein to rest securely with no danger of their falling out. Also, the tilted configuration funnels any liquid, such as rain water, which may fall into the cradle to drain 34 where it passes out of rack A.

The golf bag rack of the invention may be used to store golf bags in the home, in a storage room or adjacent a bag drop. It also may be used to display golf bags for sale in shops. Other uses and modified structures may be made without departing from the spirit of the invention.

While a preferred embodiment of the invention has been described using specific terms, such description is for illustrative purposes only, and it is to be understood that changes and variations may be made without departing from the spirit or scope of the following claims.

What is claimed is:

1. A portable rack for supporting and displaying golf bags comprising:

a housing having a base, an outer shell and a top, said top being vertically spaced from said base by said outer shell;

a bag support cradle formed within a portion of said outer shell, said cradle having a U-shaped upstanding body portion and a bottom, said body portion being slanted inward of said outer shell and said bottom being arranged perpendicular of said body portion.

2. The rack of claim 1 wherein said housing is formed with an enclosed hollow interior.

3. The rack of claim 2 including an opening formed in said outer shell, said opening providing access to said hollow interior;

a closure sized to fit in said opening, said closure being adapted to fit in said opening to seal said hollow interior.

4. The rack of claim 3 including weight means filling at least a lower portion of said interior, said weight means providing stability for said housing.

5. The rack of claim 1 including at least a pair of opposed handles formed in an upper area of said outer shell.

6. The rack of claim 5 wherein each of said handles comprise an internally directed cavity in the shape of an upwardly directed half C.

7. The rack of claim 5 wherein said rack includes a plurality of said housings secured together.

8. The rack of claim 7 wherein said housings are secured together via said handles.

9. The rack of claim 8 including a locking piece adapted to secure said housings together, said locking piece being C-shaped and adapted to engage with opposed and adjacent of said handles.

10. The rack of claim 1 wherein said bottom includes a drain arranged at its lowest point.

11. The rack of claim 10 wherein said drain comprises a tube formed with said bottom and said base, said tube extending through said cavity.

12. The rack of claim 1 wherein said housing is made of one of plastic, rubber and fiber glass.

13. The rack of claim 12 wherein said plastic comprises one of polyethylene, polyamide, and polystyrene.

14. The rack of claim 1 wherein said support member is roto-molded.

15. The rack of claim 1 wherein said top is approximately 16" in length, said base is approximately 24" in length, and said outer shell is approximately 14" wide and approximately 30" high.

16. The rack of claim 1 wherein said cradle is open at its upper end.

17. The rack of claim 16 wherein said cradle is approximately 12" wide, 9" deep and 27" in length.

18. A rack for supporting and displaying a golf bag, said rack comprising a molded housing having a top, a base, opposed sides, a back, a front, and a hollow interior;

said housing front having a golf bag supporting cradle formed therein;

said housing back having an opening formed therein providing access to said hollow interior and a removable closure adapted to fill said opening, whereby said rack may be made stable by partially filling said interior with heavy matter.

19. The rack of claim 18 wherein said cradle extends substantially the entire vertical length of said housing and is C-shaped with an open top and an enclosed bottom.

20. The rack of claim 18 wherein said cradle is tilted away from vertical so that gravity acts to securely seat a golf bag resting therein.

* * * * *